US009837729B2

(12) United States Patent
Lin

(10) Patent No.: US 9,837,729 B2
(45) Date of Patent: Dec. 5, 2017

(54) HDMI DIY CONNECTOR KIT AND METHOD OF ASSEMBLING HDMI DIY CONNECTOR

(71) Applicant: Philip Yuan Yang Lin, Taipei (TW)

(72) Inventor: Philip Yuan Yang Lin, Taipei (TW)

( * ) Notice: Subject to any disclaimer, the term of this patent is extended or adjusted under 35 U.S.C. 154(b) by 237 days.

(21) Appl. No.: 14/177,179

(22) Filed: Feb. 10, 2014

(65) Prior Publication Data

US 2015/0229041 A1 Aug. 13, 2015

(51) Int. Cl.

| | |
|---|---|
| ***H01R 4/24*** | (2006.01) |
| *H01R 24/60* | (2011.01) |
| *H01R 107/00* | (2006.01) |

(52) U.S. Cl.

CPC ..... *H01R 4/2433* (2013.01); *H01R 24/60* (2013.01); *H01R 2107/00* (2013.01); *Y10S 439/942* (2013.01)

(58) Field of Classification Search

CPC ... H01R 4/2433; H01R 24/60; H01R 2107/00
USPC ..... 439/404, 449, 456, 457, 466, 468, 942
See application file for complete search history.

(56) References Cited

U.S. PATENT DOCUMENTS 5,376,018 A * 12/1994 Davis ..... H01R 13/65802 439/395
5,806,179 A * 9/1998 Hassanzadeh ..... H01R 12/57 228/180.21
5,967,801 A * 10/1999 Martin ..... H01R 13/6466 439/404
6,932,641 B1 * 8/2005 Liao ..... H01R 13/508 439/418
7,059,914 B2 * 6/2006 Tsai ..... H01R 24/60 439/417
7,189,103 B1 * 3/2007 Brown ..... H01R 43/0263 439/493
7,192,310 B1 * 3/2007 Chao ..... H01R 4/2433 439/607.45
7,270,571 B1 * 9/2007 Huang ..... H01R 4/023 439/607.45
7,357,664 B2 * 4/2008 Hsu ..... H01R 43/0221 439/499
8,092,248 B2 * 1/2012 Van Stiphout ..... H01R 43/16 439/464
8,342,459 B2 * 1/2013 Garrison ..... H01R 12/63 248/316.7

(Continued)

*Primary Examiner* — Tulsidas C Patel
*Assistant Examiner* — Travis Chambers
(74) *Attorney, Agent, or Firm* — Raymond Y. Chan; David and Raymond Patent Firm

(57) ABSTRACT

A HDMI (High-Definition Multimedia Interface) DIY (Do-It-Yourself) connector kit includes a connector head having a plurality of terminals, a wire terminal having a plurality of alignment slots, and a wire alignment unit which includes a guider holder detachably holding the wire terminal in position and a plurality of wire slots aligned with the alignment slots respectively when the wire terminal is disposed at the guider holder. Therefore, the wire slots are arranged for retaining wires of HDMI cable in position when wire conductors thereof are inserted into the corresponding alignment slot. After the wire conductors are retained at the alignment slots, the wire terminal is detached from the guider holder to ensure only the wire conductors to be retained at the alignment slots respectively.

22 Claims, 10 Drawing Sheets

(56) References Cited

U.S. PATENT DOCUMENTS

| | | | | |
|---|---|---|---|---|
| 8,801,469 | B2 * | 8/2014 | Wu | H01R 13/6477 439/607.01 |
| 2008/0280471 | A1 * | 11/2008 | Perez | H01R 13/465 439/248 |
| 2009/0017683 | A1 * | 1/2009 | Lin | H01R 4/2404 439/607.17 |
| 2009/0017684 | A1 * | 1/2009 | Lin | H01R 4/2433 439/607.41 |
| 2011/0256756 | A1 * | 10/2011 | Lu | H01B 7/0892 439/449 |

* cited by examiner

HDMI DIY CONNECTOR KIT AND METHOD OF ASSEMBLING HDMI DIY CONNECTOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a signal connector, and more particular to a HDMI DIY (Do-It-Yourself) connector kit and a method of assembling a HDMI DIY connector, which is easy to assemble without increasing the overall size of the connector.

Description of Related Arts

HDMI (High-Definition Multimedia Interface) is a compact audio/video interface for transferring digital audio/video data from a source to an output device in a high transmission speed. Through the connection of HDMI cable, the source, such as game console or a "blue-ray" player, can transmit the uncompressed audio/video to the data output, such as television or computer monitor, to minimize any signal interference.

Generally, the HDMI cable comprises a cable body comprising a plurality of wires (such as 19 lines with or without a ground line), and a cable connector having a plurality of corresponding terminals provided therein, wherein the cable connector is connected to one end of the cable body in order to connect the wires with the terminals respectively. Each wire comprises a wire conductor enclosed within an insulating sleeve, wherein a portion of the insulating sleeve is cut off to expose the wire conductor in order to connect the wire conductor with the terminal.

The HDMI cables in different lengths can be easily found in the market. The user can select the HDMI cable from 1-meter long to 10-meter long depending the distance between the source and the output. This factory pre-made HDMI cable has a major advantage that the cable connector of the HDMI cable is relatively small because all the wires are pre-arranged and sealed at the cable connector to connect with the terminals by machine. However, it is difficult to extend the length of the HDMI cable by connecting two or more HDMI cables via an adapter or a plug.

Therefore, many installers would like to run the cable body itself inside the wall or tube. For example, the installer can run the cable body from one room to another room and manually connect the cable connector to the cable body afterwards. In other words, the installer can custom-make the HDMI cable with a desired length. The major backward of the DIY (Do-It-yourself) HDMI cable is that the installer must properly align the wires with the terminals. Accordingly, the connection of the wires to the terminals is complicated in comparison with other signal cable, such that any improper connection of the wire will affect the quality of the HDMI cable.

Accordingly, in order to ensure the proper alignment of the wires, the cable connector of such non-factory HDMI cable comprises a front connector portion where the terminals are located, and a rear wire holding portion having a plurality of wire alignment holes extended to the terminals respectively. The wires are guided to insert into the wire alignment holes to contact with the terminals respectively. The cable connector further comprises an outer adapter coupled at the connector portion to affix the wire conductors at the terminals and to hold the wires at the wire alignment holes respectively. As a result, the overall size of the cable connector is relatively bulky comparing with the cable connector of the factory HDMI cable because the wires are held at the wire alignment holes to connect with the terminals in the structure of the cable connector of the factory HDMI cable.

It is worth mentioning that the wires are thin. The size of wire holding portion must be big enough for the wires to insert into the wire alignment holes respectively. Unlike the factory HDMI cable, the installer must insert the wires into the wire alignment holes one by one for the non-factory HDMI cable. Therefore, there must be a space between every two adjacent holes in order to organize all the wires at the cable connector in a pre-determined order with respect to the terminals. In addition, the installer must have enough experience for inserting into the wire alignment hole in order to contact with the terminal. If one of the wires does not contact the terminal properly, the HDMI cable will not be functioned properly. Once the outer adapter is coupled at the connector portion, the wires are permanently affixed at the terminals. Any improper connection of the wire to the terminal will cause the installer to cut off the cable connector from the cable body and to re-connect a new cable connector with the cable body.

SUMMARY OF THE PRESENT INVENTION

The invention is advantageous in that it provides a HDMI (High-Definition Multimedia Interface) DIY (Do-It-Yourself) connector, wherein the wire alignment structure is not built-in with the connector so as to substantially reduce the overall size of the connector.

Another advantage of the invention is to provide a HDMI DIY connector, which is a non-factory HDMI connector to enable the installer to run the cable and connect the connector at one end of the cable.

Another advantage of the invention is to provide a HDMI DIY connector, wherein the wires of the HDMI cable are guided by a wire alignment unit to ensure the wire conductors to be secured at the alignment slots of the wire terminal. After the wire conductors are secured at the wire coupling slots, the wire alignment unit can be removed from the wire terminal to reduce the overall size of the connector.

Another advantage of the invention is to provide a HDMI DIY connector, wherein an entrance of each alignment slot has a chamfered edge for enabling the wire conductor to be easily inserted thereinto. In addition, the diameter of each alignment slot is gradually reduced from the entrance thereof, such that the diameter of each alignment slot is reduced to match with the diameter of the wire conductor in order to secure the wire at the wire coupling slot.

Another advantage of the invention is to provide a HDMI DIY connector, wherein the wire terminal is coupled with the connector head via a terminal connector in order to ensure the wire conductors to be connected at the terminals respectively.

Another advantage of the invention is to provide a HDMI DIY connector, wherein the wire conductors are connected at the terminals respectively without soldering or welding.

Another advantage of the invention is to provide a method of assembling a HDMI DIY connector, which is easy to assemble without increasing the overall size of the connector.

Another advantage of the invention is to provide a HDMI DIY connector kit, which does not require to alter the original structural design of the HDMI cable, so as to minimize the manufacturing cost of the connector incorporating with the HDMI cable.

Another advantage of the invention is to provide a HDMI DIY connector kit, wherein no expensive or complicated structure is required to employ in the present invention in order to achieve the above mentioned objects. Therefore, the present invention successfully provides an economic and efficient solution for providing a secure configuration for connecting wires of the HDMI cable with the connector without substantially increasing the overall size thereof and for providing a simple wire alignment structure to guide and correct the alignment of each wire to be connected to the corresponding terminal.

Additional advantages and features of the invention will become apparent from the description which follows, and may be realized by means of the instrumentalities and combinations particular point out in the appended claims.

According to the present invention, the foregoing and other objects and advantages are attained by a HDMI (High-Definition Multimedia Interface) DIY (Do-It-Yourself) connector for connecting wires of a HDMI cable, comprising:

a connector head which comprises a plurality of terminals;

a wire terminal having a plurality of wire coupling slots for enabling the wires to be inserted thereinto respectively; and a terminal connector coupled the wire terminal with the connector head for affixing wire conductors of the wires at the terminals respectively. Thereby, the wires are alignedly inserted into the wire coupling slots via a wire alignment unit. Once the wires are secured at the wire coupling slots, the wire alignment unit is detached from the wire terminal.

In accordance with another aspect of the invention, the present invention comprises a method of assembling a HDMI DIY connector, which comprises a connector head and a wire terminal, with wires of a HDMI cable, comprising the following steps.

(A) Insert the wires into a plurality of wire coupling slots of the wire terminal via a wire alignment unit by the steps of:

(A.1) disposing the wire terminal at a guider holder of the wire alignment unit to align a plurality of wire alignment slots of the wire alignment unit with the wire coupling slots respectively;

(A.2) inserting the wires into the wire coupling slots through the wire alignment slots respectively; and (A.3) detaching the wire alignment unit from the wire terminal to disengage the wires from the wire alignment slots respectively, such that the wires are retained at the wire coupling slots respectively.

(B) Affix the wire terminal to the connector head for contacting wire conductors of the wires at the terminals respectively.

In accordance with another aspect of the invention, the present invention further comprises a HDMI (High-Definition Multimedia Interface) DIY (Do-It-Yourself) connector kit for connecting wires of a HDMI cable, comprising:

a connector head which comprises a plurality of terminals;

a wire terminal having a plurality of wire coupling slots for enabling the wires to be inserted thereinto respectively, wherein the wire terminal is coupled with the connector head for conductively connecting wire conductors of the wires with the terminals respectively; and a wire alignment unit which comprises a guider holder detachably holding the wire terminal in position, and a plurality of wire alignment slots aligned with the wire coupling slots respectively when the wire terminal is disposed at the guider holder, wherein each of the wire alignment slots is arranged for retaining the wire in position when the wire is inserted into the corresponding wire coupling slot. Once the wires are retained at the wire coupling slots, the wire terminal is detached from the guider holder for disengaging the wires from the wire alignment slots respectively so as to ensure the wires to be retained at the wire coupling slots respectively.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
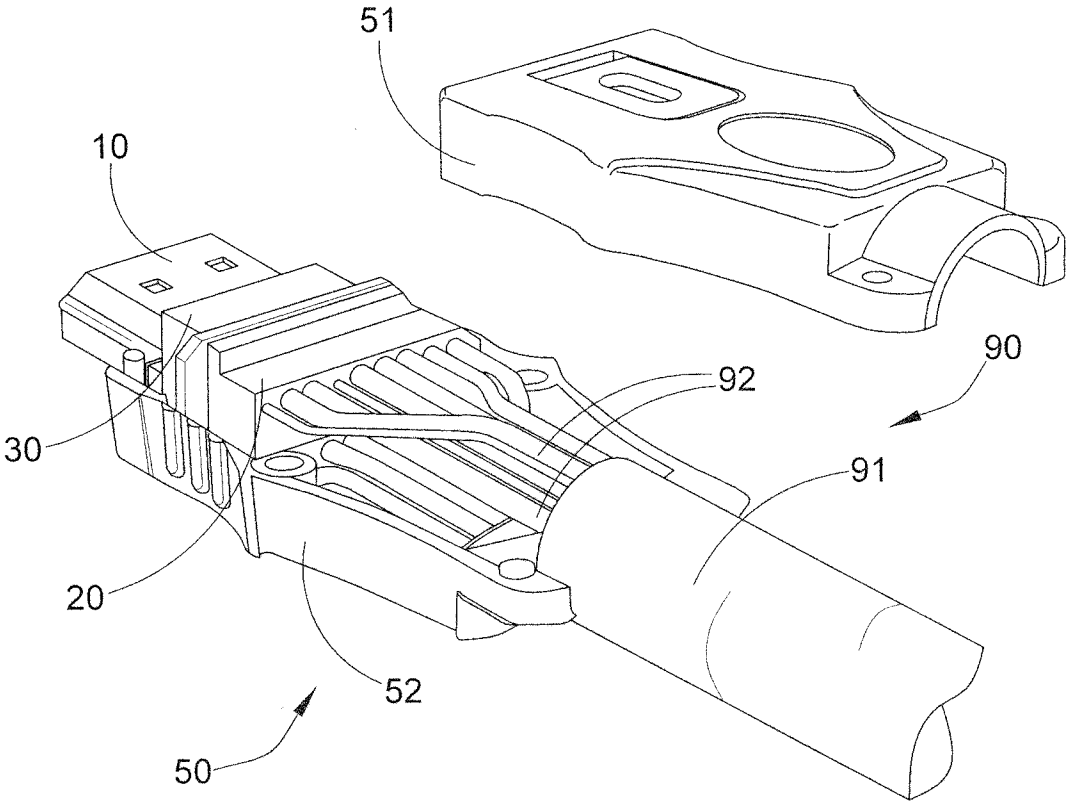
FIG. 1 is an exploded perspective view of a HDMI DIY connector according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 9, a HDMI (High-Definition Multimedia Interface) DIY (Do-It-Yourself) connector kit for a HDMI cable is illustrated. Accordingly, the HDMI cable 90 generally comprises a shield sleeve 91 and a plurality of wires 92 received in and extended along the shield sleeve 91, wherein each of the wires 92 comprises an insulating sleeve 921 and a wire conductor 922 received in and extended along the insulating sleeve 921. For example, the HDMI cable 90 comprises 19 wires 92 configured in different color codes.

According to the preferred embodiment, the HDMI cable connector kit comprises a HDMI cable connector and a wire alignment unit 40, wherein the installer is able to run the HDMI cable 90 at any place and to connect the end portion of the HDMI cable 90 to the HDMI DIY connector.

The HDMI DIY connector comprises a connector head 10 and a wire terminal 20. The connector head 10 comprises a plurality of terminals 11, a HDMI plug 12, and a circuit board 13 rearwardly extended from the HDMI plug 12, wherein the terminals 11 are spacedly provided at top and bottom sides of the circuit board 13.

The wire terminal 20 has a plurality of wire coupling slots 21 for enabling the wires 92 to be inserted thereinto respectively, wherein the wire terminal 20 is coupled with the connector head 10 for conductively connecting the wire conductors 922 of the wires 92 with the terminals 11 respectively.

According to the preferred embodiment, two wire terminals 20, i.e. upper and lower wire terminals, are used for retaining the wires 92, wherein the circuit board 13 is sandwiched between the two wire terminals 20 to connect the wire conductors 922 of the wires 92 with the terminals 11 at the top and bottom sides of the circuit board 13. Preferably, the upper wire terminals 20 contains ten wire coupling slots 21 while the lower wire terminals 20 contains nine wire coupling slots 21.

Figure 4:
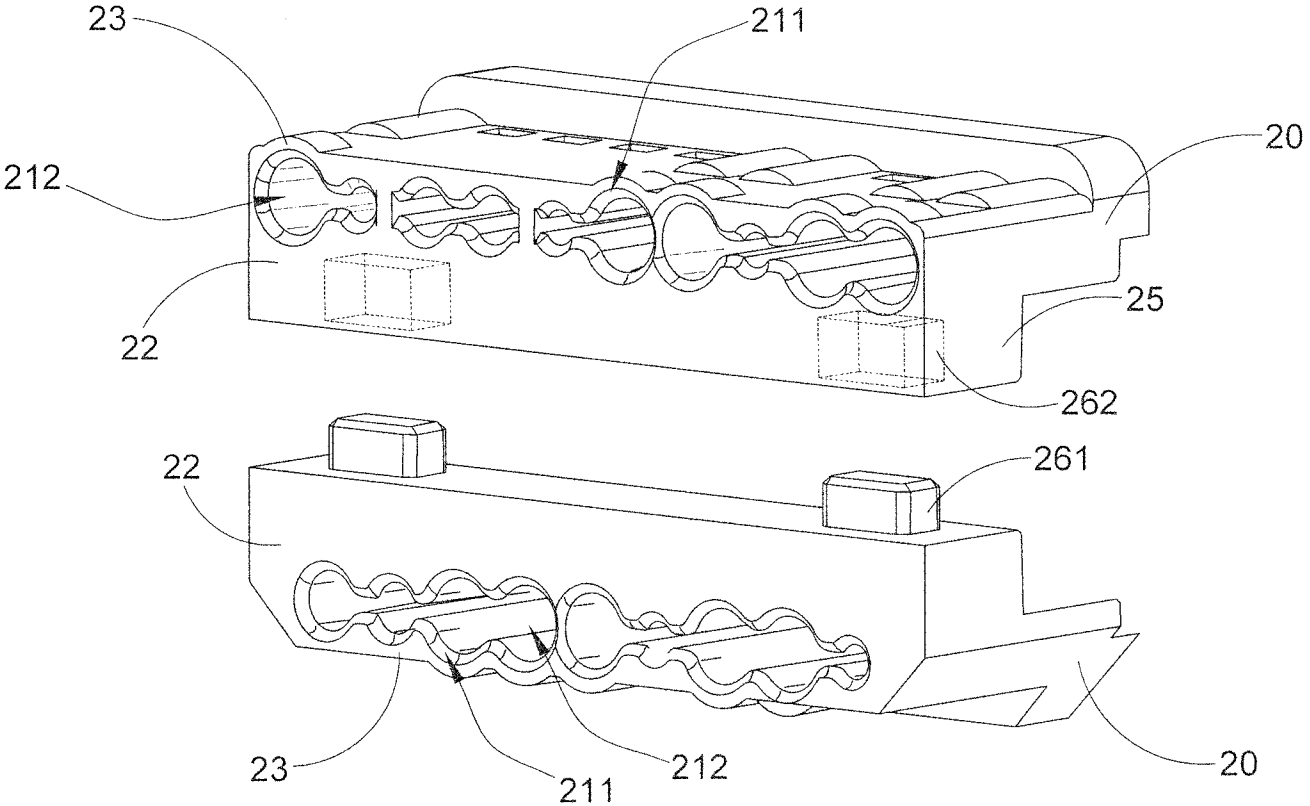
FIG. 4 is a perspective view of the wire terminals of the HDMI DIY connector according to the above preferred embodiment of the present invention.

As shown in FIG. 4, each of the wire terminals 20 comprises a lower guiding platform 22 and an upper guiding platform 23 to define the wire coupling slots 21 therebetween for securely retaining the wires 92 at the wire coupling slots 21 respectively. Each of the wire terminals 20 further has a plurality of guiding slots 24 spacedly formed at a bottom side of the lower guiding platform 22 to align with the wire coupling slots 21 respectively. The two wire terminals 20 are interlocked with each other, wherein one of the wire terminals 20 comprises a first interlocker 261 at the upper guiding platform 23 thereof, and another wire terminal 20 comprises a first interlocking slot 262 upper guiding platform 23 thereof, such that when the first interlocker 261 is interlocked and engaged with the first interlocking slot 262, the two wire terminals 20 are interlocked with each other.

Figure 5:
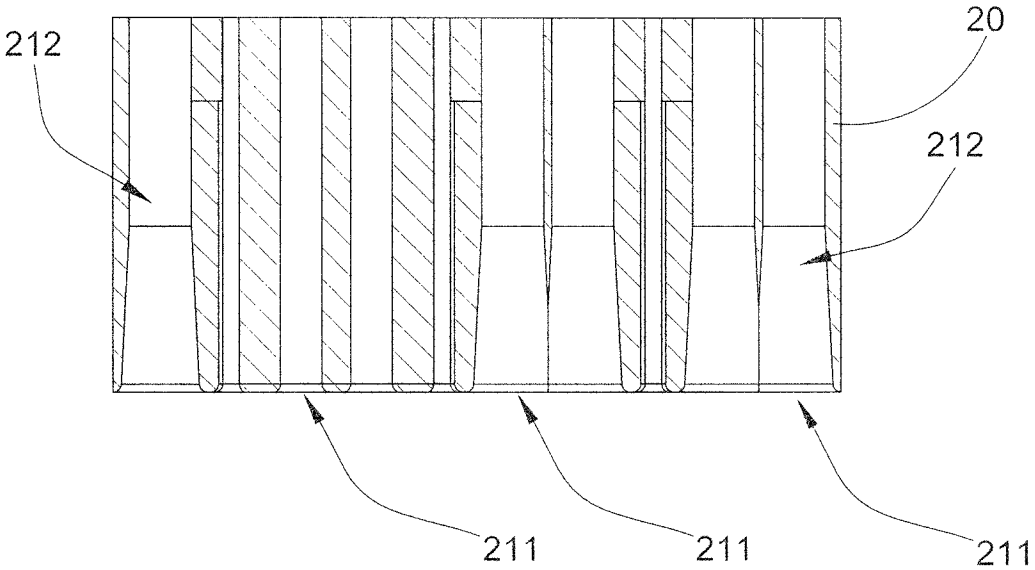
FIG. 5 is a sectional view of the wire terminal of the HDMI DIY connector according to the above preferred embodiment of the present invention.

Each of the wire coupling slots 21 has an entrance 211 for the wire 92 inserting thereinto and define an elongated wire coupling channel 212 extended from the entrance 211 to retain the wire 92 in position. As shown in FIG. 5, the entrance 211 of each of the wire coupling slots 21 has a chamfered edge to guide the wire 92 inserting into the wire coupling channel 212. A diameter of at least one of the wire coupling slots 21 is gradually reduced from the entrance 211 until the diameter of the wire coupling slots 21 matches with a diameter of the wire 92. In other words, a diameter of the coupling channel 212 matches with the diameter of the wire 92.

Figure 2:
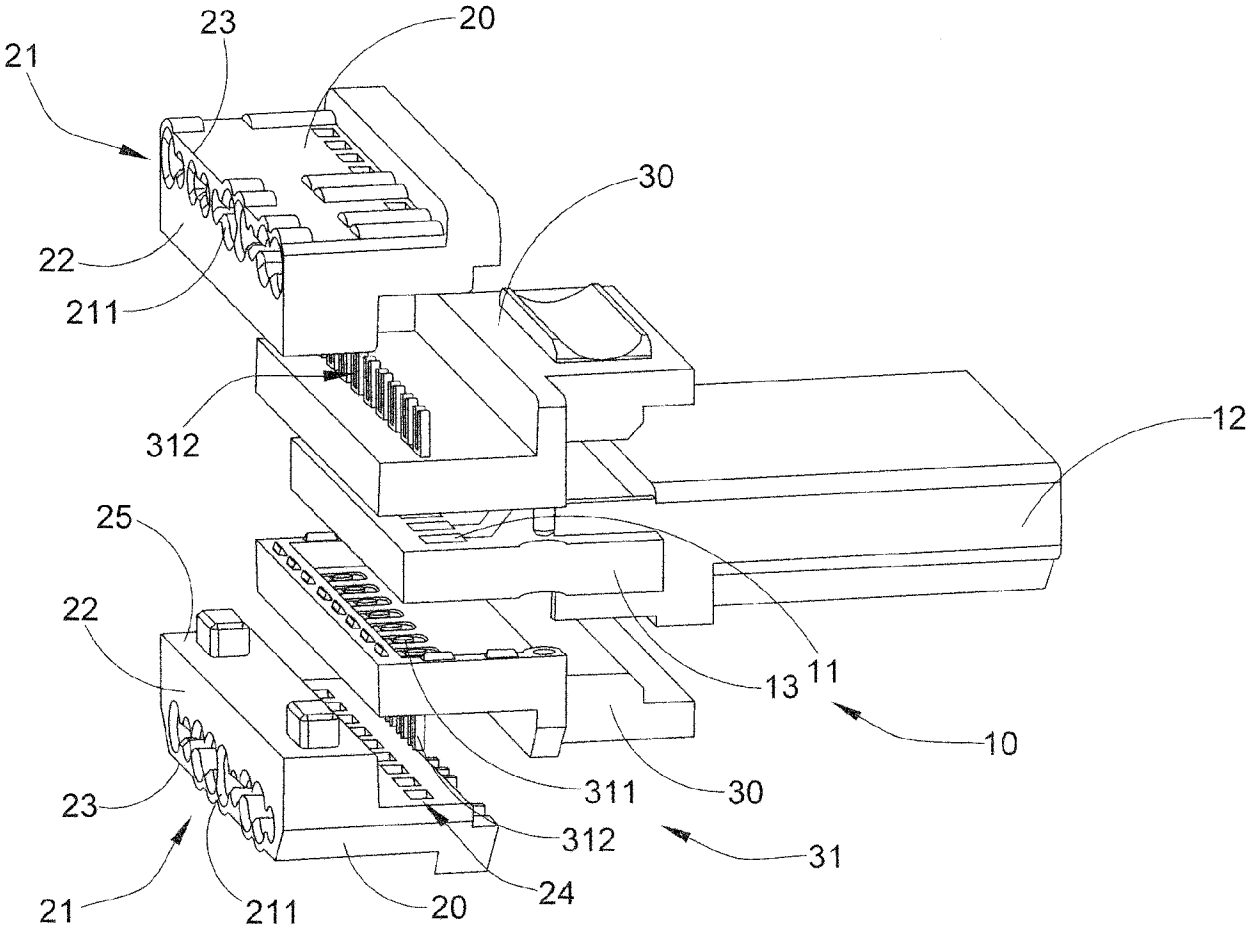
FIG. 2 is an exploded perspective view of the connector head, the wire terminals, and the terminal connectors of the HDMI DIY connector according to the above preferred embodiment of the present invention.

According to the preferred embodiment, the HDMI DIY connector further comprises a terminal connector 30 coupled each of the wire terminals with the connector head 10 for affixing the wire conductors 922 of the wires 92 at the terminals 11 respectively. Each of the terminal connector 30 is coupled between the wire terminal 20 and the connector head 10 for affixing the wire conductors 922 at the terminals 11 respectively, as shown in FIG. 2, wherein the terminal connectors 30 are interlocked with each other to sandwich the circuit board 13 between the terminal connectors 30.

Figure 3:
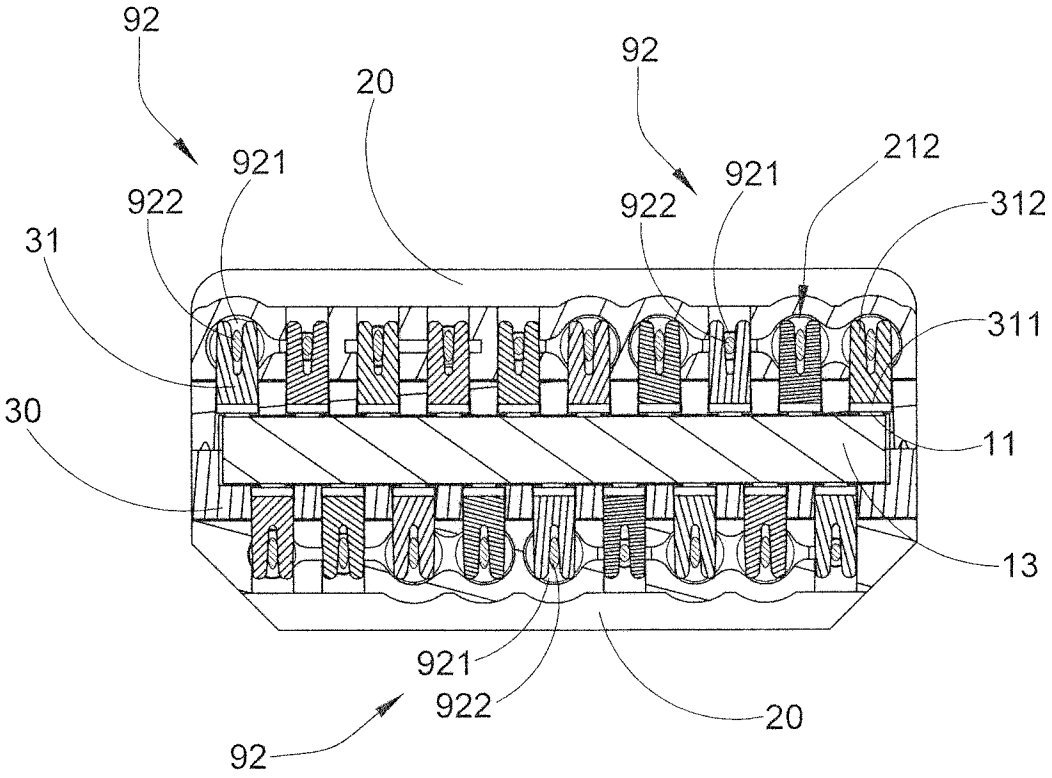
FIG. 3 is a sectional view of the HDMI DIY connector according to the above preferred embodiment of the present invention.

Each of the terminal connectors 30 comprises a plurality of conducting probes 31, each of the conducting probes 31 having a terminal end 311 contacted with the corresponding terminal 11 and an affixing end 312 for affixing to the corresponding wire conductor 922. When the terminal connectors 30 are interlocked with each other and are affixed to the connector head 10, the terminal ends 311 of the conducting probes 31 contact with the terminals 11 at the top and bottom sides of the circuit board 13 respectively, as shown in FIG. 3.

The terminal connectors 30 are sandwiched between the wire terminals 20, wherein when the wire terminal 20 is coupled at the respective terminal connector 30, the affixing ends 312 of the conducting probes 31 are inserted into the guiding slots 24 of the wire terminal 20 respectively for affixing the affixing ends 312 of the conducting probes 31 at the wire conductors 922 respectively. In particular, the affixing end 312 of each of the conducting probes 312 has a Y-shaped configuration and defines two penetrating arms, wherein when the affixing end 312 of the conducting probe 31 is inserted into the guiding slot 24, the penetrating arms arrange for penetrating into the wire 92 through the insulating sleeve 921 to connect with the wire conductor 922 thereof so as to securely connect the wire conductor 922 between the penetrating arms of the conducting probe 31.

The HDMI DIY connector comprises a casing 50 for housing the connector head 10, the wire terminals 20, and the terminal connectors 30. The casing 50 comprises upper and lower casing bodies 51, 52 detachably coupled via screws in order to secure the connector head 10, the wire terminals 20, and the terminal connectors 30 between the upper and lower casing bodies 51, 52, so as to secure the HDMI cable 90 with respect to the connector head 10.

According to the preferred embodiment, the wires 92 are guided and aligned to be inserted into the wire coupling slots 21 of the wire terminal 20 via the wire alignment unit 40.

As shown in FIGS. 6 to 10, the wire alignment unit 40, which is a wire glider, comprises a guider holder 41 detachably holding the wire terminal 20 in position, and a plurality of wire alignment slots 42 aligned with the wire coupling slots 21 respectively when the wire terminal 20 is disposed at the guider holder 41, wherein each of the wire alignment slots 42 is arranged for retaining the wire 92 in position when the wire 92 is inserted into the corresponding wire coupling slot 21.

Figure 6:
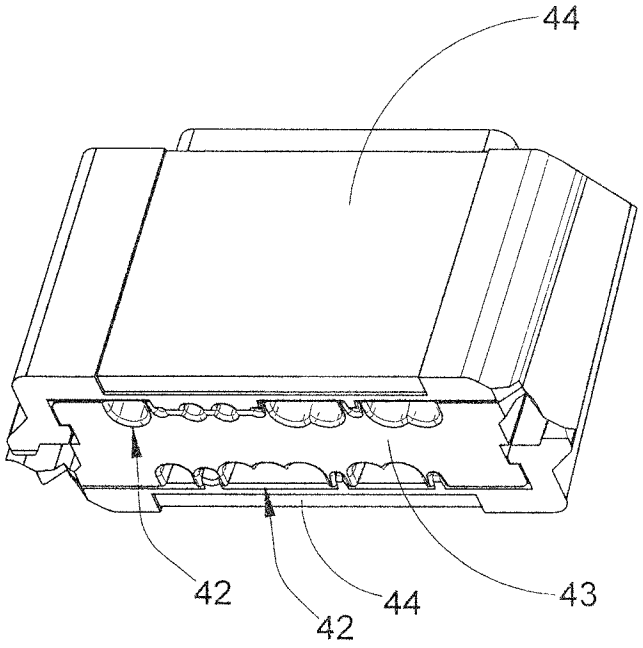
FIG. 6 is a perspective view of a wire alignment unit of a HDMI DIY connector kit according to the above preferred embodiment of the present invention.
Figure 7:
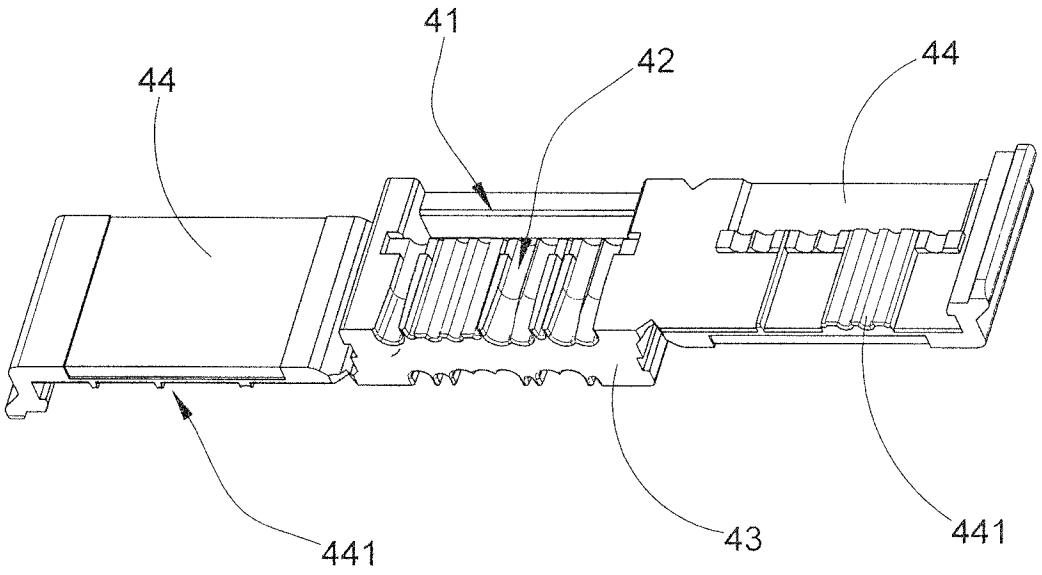
FIG. 7 is a perspective view of the wire alignment unit of the HDMI DIY connector kit according to the above preferred embodiment of the present invention, illustrating the hood covers being folded to open the wire alignment slots.
Figure 8:
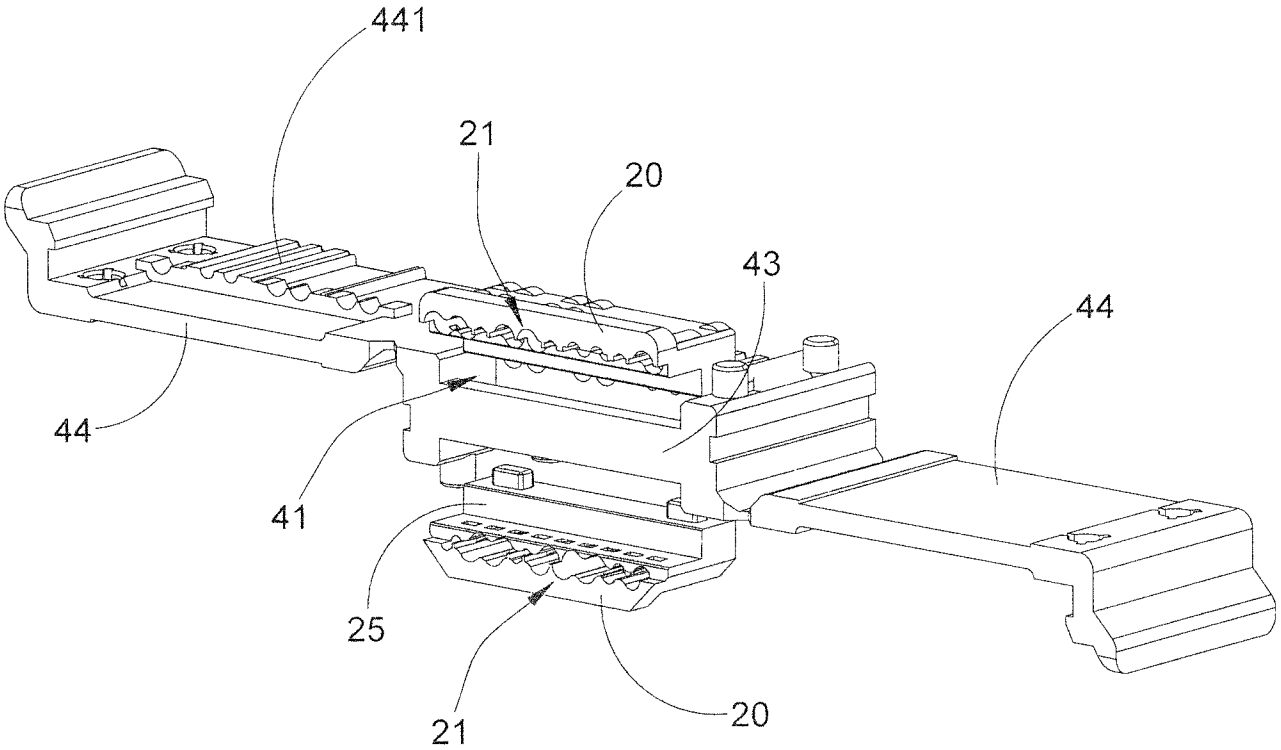
FIG. 8 is a perspective view of the wire alignment unit of the HDMI DIY connector kit according to the above preferred embodiment of the present invention, illustrating the wire terminals being coupled with the wire alignment unit.

As shown in FIGS. 6 and 7, the wire alignment unit 40 further comprises a base member 43 and two hood covers 44 foldably coupled with the base member 43. The guider holder 41, which is formed as an indention, formed at a front portion of the base member 43 at each of the upper and bottom sides thereof for receiving the wire terminal 20. The wire alignment slots 42 are spacedly formed at a rear portion of the base member 43 at each of the upper and bottom sides thereof for receiving the wires 92. In other words, the two wire terminals 20 are disposed at the guider holders 41 at the upper and bottom sides of the base member 43 respectively.

Accordingly, each of the wire terminals 20 further comprises a guiding base 25 downwardly extended from the lower guiding platform 22, wherein the guiding base 25 is disposed at the guider holder 41. In particular, when the guiding base 25 is disposed at the guider holder 41, the wire coupling slots 21 are located above the upper or bottom side of the base member 43. Therefore, the wires 92 can extend through the wire coupling slots 21 when the wire terminal 20 is held by the wire alignment unit 40.

Figure 9:
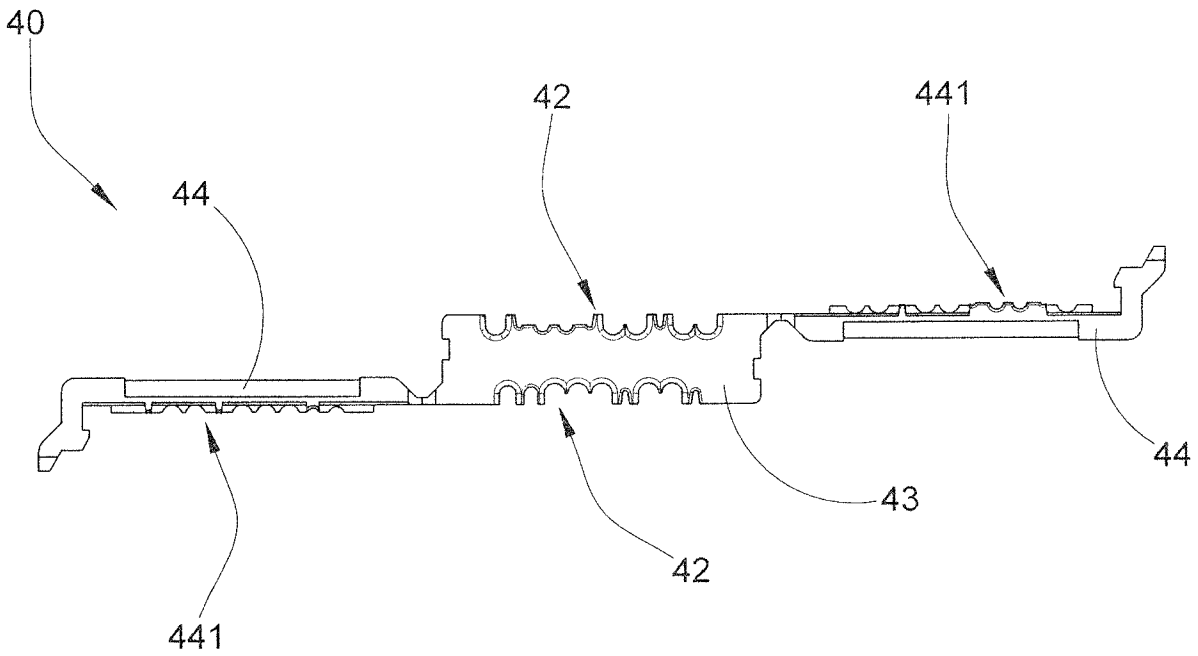
FIG. 9 is a front sectional view of the wire alignment unit of the HDMI DIY connector kit according to the above preferred embodiment of the present invention.
Figure 10:
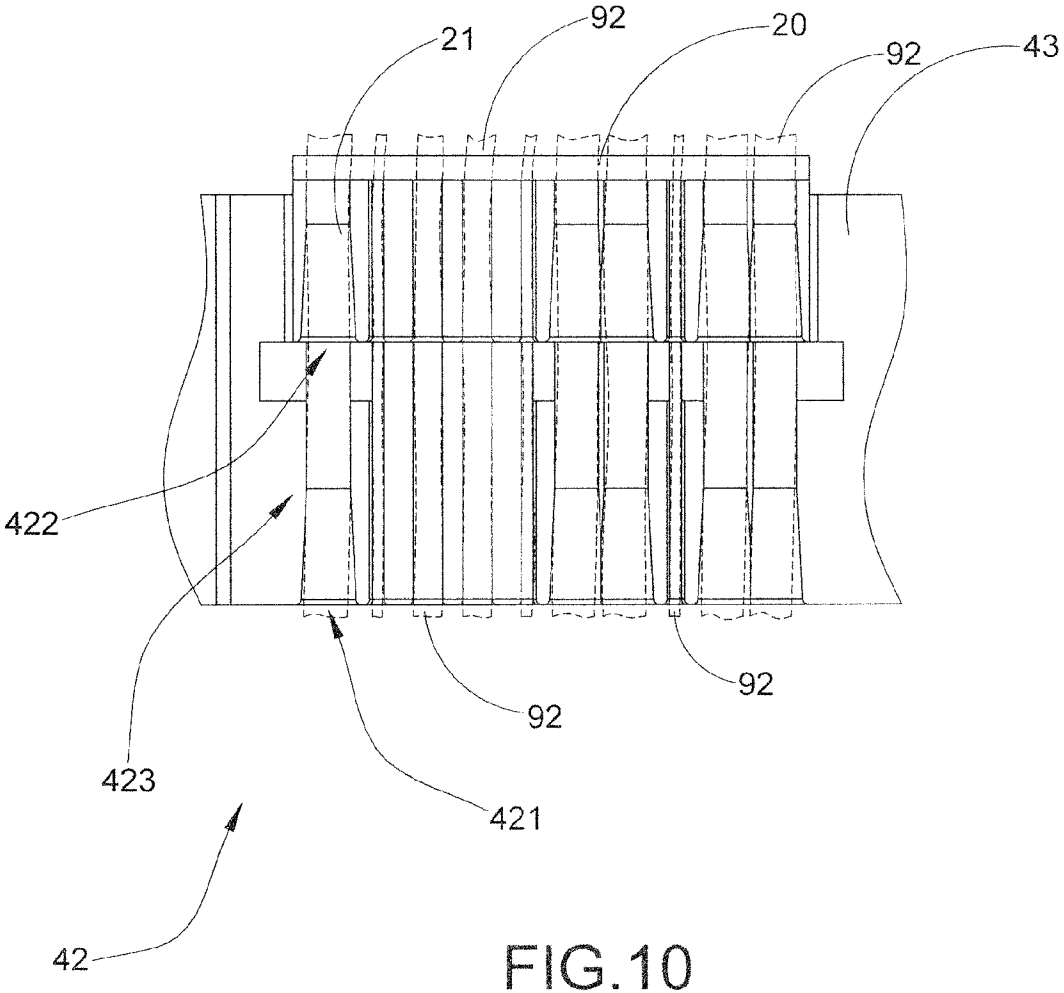
FIG. 10 is a top sectional view of the wire alignment unit of the HDMI DIY connector kit according to the above preferred embodiment of the present invention, illustrating the alignment between the wire coupling slots and the wire alignment slots.

Each of the wire alignment slots 42 has an entrance 421 and an exit 422, and defines an alignment channel 423 between the entrance 421 and the exit 422, as shown in FIG. 9, wherein the exit 422 of the wire alignment slot 42 is coaxially aligned with the entrance 211 of the corresponding wire coupling slot 21. In other words, the wire alignment slots 42 are aligned with the wire coupling slots 21 end-to-end. In particular, the entrance 421 of each of the wire alignment slots 42 has a chamfered edge such that the wire 92 can be easily inserted into the alignment channel 423 through the entrance 421. A diameter of at least one of the wire alignment slots 42 are gradually reduced from the entrance 421 thereof. Preferably, the diameter of the alignment channel 423 matches with the diameter of the wire 92. Therefore, when the wire 92 is slid at the wire alignment slots 42 until the wire 92 is inserted into the corresponding wire coupling slot 21.

The hood covers 44 are pivotally coupled at two opposed sides of the base member 43 respectively, wherein the hood covers 44 are integrally and pivotally folded to hood cover on the upper and lower sides of the base member 43 respectively. Accordingly, when the hood covers 44 are folded on the upper and bottom sides of the base member 43, the guider holders 41 and the wire alignment slots 42 are hood covered by the hood covers 44. In particular, each of the hood covers 44 has a folding edge pivotally extended from one side of the base member 43 and a locking edge detachably coupled at an opposed side of the base member 43.

In addition, each of the hood covers 44 has a wire holding grid 441 integrally protruded from an inner side thereof to align with the wire alignment slots 42. Accordingly, after the wires 92 are slid at the wire alignment slots 42 at a position that the wires 92 are inserted into the wire coupling slots 21 respectively, the corresponding hood cover 44 is folded to hood cover on the base member 43 for retaining the wire terminal 20 at the guider holder 41. At the same time, the wire holding grid 441 is pressed on the wires 92 to retain the wires 92 at the wire alignment slots 42. Therefore, the wires 92 are locked by the wire holding grid 441 along the wire alignment slots 422 to retain the distance between the wires and the wire terminal 20. It is worth mentioning that each of the wire alignment slots 422 has a top opening formed between the entrance 421 and the exit 422 to open up the alignment channel 432, wherein the wire holding grid 441 matches with the top openings of the wire alignment slots 422 to close the alignment channel 432 when the hood cover 44 is folded to cover at the base member 43.

When one of the hood covers 44 is folded to hood cover at the upper side of the base member 43, i.e. the wires 92 are already inserted into the wire coupling slots 21, the base member 43 can be flipped up-side-down in order to complete another wire alignment process at the bottom side of the base member 43. It is worth mentioning that two wire terminals 20 are supported at the upper and bottom sides of the base member 43 respectively. Therefore, the installer is able to insert the first set of the wires 92 into the wire coupling slots 21 at one of the wire terminals 20 and then to insert the second set of the wires 92 into the wire coupling slots 21 at another wire terminal 20. When the wires 92 are inserted into the wire coupling slots 21 of the two wire terminals 20, the wire terminals 20 are retained in a proper position corresponding to each other. Therefore, the two wire terminals 20 can be coupled to the terminal connectors 30 correspondingly.

Once the wires 92 are retained at the wire coupling slots 21, the wire terminal 20 is detached from the guider holder 41 for disengaging the wires 92 from the wire alignment slots 42 respectively so as to ensure the wires 92 to be retained at the wire coupling slots 21 respectively. In particular, the wires 92 are ensured to be retained with a predetermined distance with respect to the wire terminals 20. After the wire terminals 20 are detached from the wire alignment unit 40, the wire terminals 20 can be affixed to the connector head 10 via the terminal connectors 30.

According to the preferred embodiment, the present invention further comprises a method assembling the HDMI DIY connector with the HDMI cable, which comprises the following steps.

(1) Insert the wires 92 into the wire coupling slots 21 of the wire terminal 20 via the wire alignment unit 40 by the wire alignment process.

(2) Affix the wire terminal 20 to the connector head 10 for contacting the wire conductors 922 of the wires 92 at the terminals 11 respectively.

Before, the step (1), a portion of the shield sleeve 91 is removed in order to expose the end portions of the wires 92. Preferably, the exposed breading and drain wire are trimmed off for neat and clean termination. Then, the wires 92 can be separated into two sets according to the color code settings.

Accordingly, the wire alignment process comprises the following the steps.

(1.1) Dispose the guiding base 25 of the wire terminal 20 at the guider holder 41 on the upper side of the base member 43 to align the wire alignment slots 42 of the wire alignment unit 40 with the wire coupling slots 21 respectively.

(1.2) Insert the first set of the wires 92 into the wire coupling slots 21 through the wire alignment slots 42 respectively.

(1.3) Fold the corresponding hood cover 44 to hood cover on the upper side of the base member 43 in order to retain the wire terminal 20 and the wires 92 thereat.

(1.4) Flip the base member 43 up-side-down.

(1.5) Dispose the guiding base 25 of the wire terminal 20 at the guider holder 41 on the bottom side of the base member 43 to align the wire alignment slots 42 of the wire alignment unit 40 with the wire coupling slots 21 respectively.

(1.6) Insert the second set of the wires 92 into the wire coupling slots 21 through the wire alignment slots 42 respectively.

(1.7) Fold the corresponding hood cover 44 to hood cover on the bottom side of the base member 43 in order to retain the wire terminal 20 and the wires 92 thereat. Therefore, the wires 92 are already inserted into the wire coupling slots 21 of the wire terminals 20 with a proper distance.

It is worth mentioning that after feeding through all the wires 92 into the wire coupling slots 21 of the wire terminals 20, the installer can trim off the excessive wires 92 out of the exits of the wire coupling slots 21 for an even parallel alignment.

(1.8) Detach the wire alignment unit 40 from the wire terminals 20 to disengage the wires 92 from the wire alignment slots 42 respectively, such that the wires 92 are retained at the wire coupling slots 21 respectively. Accordingly, by unfolding the hood covers 40, the wire terminals 20 can be easily removed from the wire alignment unit 40 at the upper and bottom sides thereof.

Accordingly, in the step (2), the wire terminals 20 are affixed to the connector head 10 via the terminal connectors 30 by the following steps.

(2.1) Configure the conducting probes 31 at the terminal connector 30 for conducting the wire conductors 922 with the terminals 11 respectively.

(2.2) Contact the terminal ends 311 of the conducting probes 31 with the terminals 11 when the terminal connector 30 is coupled at the connector head 10.

(2.3) Affix the affixing end 312 of the conducting probes 31 at the wire conductors 922 when the terminal connector 30 is coupled at the wire terminal 20. Accordingly, the affixing ends 312 of the conducting probes 31 are inserted into the guiding slots 24 of the wire terminal 20 respectively for affixing the affixing ends 312 of the conducting probes 31 at the wire conductors 922 respectively.

Accordingly, the wire terminals 20 can be affixed to the terminal connectors 30 via a crimping tool to complete the termination. Then, the wire connection is completed and the connector can be secured in the casing 50.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A HDMI (High-Definition Multimedia Interface) DIY (Do-It-Yourself) connector for connecting wires of a HDMI cable, comprising:

a connector head which comprises a plurality of terminals;

a wire terminal having a plurality of wire coupling slots for enabling said wires to be inserted thereinto respectively; and a terminal connector coupled said wire terminal with said connector head for affixing wire conductors of said wires at said terminals respectively, wherein said terminal connector comprises a plurality of conducting probes, each of said conducting probes having a terminal end contacted with said corresponding terminal and an affixing end for affixing to said corresponding wire conductor;

whereby, said wires are alignedly inserted into said wire coupling slots via a wire alignment unit, which has a guider holder and a plurality of wire alignment slots, by the steps of:

(a) disposing said wire terminal at said guider holder to align said wire alignment slots with said wire coupling slots respectively;

(b) inserting said wires into the wire coupling slots through said wire alignment slots respectively; and (c) disengaging said wires from said wire alignment slots respectively to detach said wire alignment unit from said wire terminal, such that said wires are retained at said wire coupling slots respectively.

2. The HDMI DIY connector, as recited in claim 1, wherein said wire terminal comprises a lower guiding platform and an upper guiding platform to define said wire coupling slots therebetween for securely retaining said wires at said wire coupling slots respectively.

3. The HDMI DIY connector, as recited in claim 1, wherein an entrance of each of said wire coupling slots has a chamfered edge and a diameter of said wire coupling slot is gradually reduced from said entrance until said diameter of said wire coupling slot matches with a diameter of said wire, wherein said wire terminal comprises a lower guiding platform and an upper guiding platform to define said wire coupling slots therebetween for securely retaining said wires at said wire coupling slots respectively.

4. The HDMI DIY connector, as recited in claim 2, wherein said wire terminal further has a plurality of guiding slots spacedly formed at a bottom side of said lower guiding platform to align with said wire coupling slots respectively, wherein said affixing ends of said conducting probes are inserted into said guiding slots respectively for affixing said affixing ends of said conducting probes at said wire conductors respectively.

5. The HDMI DIY connector, as recited in claim 4, wherein said affixing end of each of said conducting probes has a Y-shaped configuration and defines two penetrating arms, wherein when said affixing end of said conducting probe is inserted into said guiding slot, said penetrating arms arrange for penetrating into said wire to connect with said wire conductor thereof so as to securely connect said wire conductor between said penetrating arms.

6. The HDMI DIY connector, as recited in claim 3, wherein said wire terminal further has a plurality of guiding slots spacedly formed at a bottom side of said lower guiding platform to align with said wire coupling slots respectively, wherein said affixing ends of said conducting probes are inserted into said guiding slots respectively for affixing said affixing ends of said conducting probes at said wire conductors respectively.

7. The HDMI DIY connector, as recited in claim 6, wherein said affixing end of each of said conducting probes has a Y-shaped configuration and defines two penetrating arms, wherein when said affixing end of said conducting probe is inserted into said guiding slot, said penetrating arms arrange for penetrating into said wire to connect with said wire conductor thereof so as to securely connect said wire conductor between said penetrating arms.

8. The HDMI DIY connector, as recited in claim 7, wherein said terminal connector coupled between said wire terminal and said connector head for affixing said wire conductors at said terminals respectively.

9. A method of assembling a HDMI DIY connector, which comprises a connector head and a wire terminal, with wires of a HDMI cable, comprising the steps of:

(a) inserting said wires into a plurality of wire coupling slots of said wire terminal via a wire alignment unit by the steps of:

(a.1) disposing said wire terminal at a guider holder of said wire alignment unit to align a plurality of wire alignment slots of said wire alignment unit with said wire coupling slots respectively;

(a.2) inserting said wires into the wire coupling slots through said wire alignment slots respectively; and (a.3) detaching said wire alignment unit from said wire terminal to disengage said wires from said wire alignment slots respectively, such that said wires are retained at said wire coupling slots respectively; and (b) affixing said wire terminal to said connector head for contacting wire conductors of said wires at said terminals respectively, wherein said wire terminal is affixed to said connector head via a terminal connector by the steps of:

(b.1) configuring a plurality of conducting probes at said terminal connector for conducting said wire conductors with said terminals respectively;

(b.2) contacting a plurality of terminal ends of said conducting probes with said terminals when said terminal connector is coupled at said connector head; and (b.3) affixing a plurality of affixing end of said conducting probes at said wire conductors when said terminal connector is coupled at said wire terminal.

10. The method, as recited in claim 9, wherein, in the step (a.2), a hood cover of said wire alignment unit is folded to hood cover said wire terminal at said guiding holder to ensure said wire alignment slots to be aligned with said wire coupling slots respectively, wherein the step (a.2) further comprises the steps of:

(a.2.1) configuring said wire terminal to have a lower guiding platform and an upper guiding platform, wherein said wire coupling slots is defined between said lower guiding platform and said upper guiding platform; and (a.2.2) securely retaining said wires at said wire coupling slots respectively between said lower and upper guiding platforms.

11. The method, as recited in claim 9, wherein said terminal connector coupled between said wire terminal and said connector head for affixing said wire conductors at said terminals respectively.

12. The method, as recited in claim 9, wherein said wire terminal has a plurality of guiding slots aligned with said wire coupling slots respectively, wherein said affixing ends of said conducting probes are inserted into said guiding slots respectively for affixing said affixing ends of said conducting probes at said wire conductors respectively.

13. The method, as recited in claim 12, wherein said affixing ends of each of said conducting probes has a Y-shaped configuration and defines two penetrating arms, wherein when said affixing end of said conducting probe is inserted into said guiding slot, said penetrating arms arrange for penetrating into said wire to connect with said wire conductor thereof so as to securely connect said wire conductor between said penetrating arms.

14. The method, as recited in claim 13, wherein an entrance of each of said wire coupling slots has a chamfered edge and a diameter of said wire coupling slot is gradually reduced from said entrance until said diameter of said wire coupling slot matches with a diameter of said wire.

15. The method, as recited in claim 14, wherein the step (a.2) further comprises the steps of:

(a.2.1) configuring said wire terminal to have a lower guiding platform and an upper guiding platform, wherein said wire coupling slots is defined between said lower guiding platform and said upper guiding platform; and (a.2.2) securely retaining said wires at said wire coupling slots respectively between said lower and upper guiding platforms.

16. The method as recited in claim 15, wherein, in the step (a.2), a hood cover of said wire alignment unit is folded to hood cover said wire terminal at said guiding holder to ensure said wire alignment slots to be aligned with said wire coupling slots respectively.

17. The method, as recited in claim 16, wherein said terminal connector coupled between said wire terminal and said connector head for affixing said wire conductors at said terminals respectively.

18. A HDMI (High-Definition Multimedia Interface) DIY (Do-It-Yourself) connector kit for connecting wires of a HDMI cable, comprising:

a connector head which comprises a plurality of terminals;

a wire terminal having a plurality of wire coupling slots for enabling said wires to be inserted thereinto respectively, wherein said wire terminal is coupled with said connector head for conductively connecting wire conductors of said wires with said terminals respectively; and a wire alignment unit, which comprises:

a guider holder detachably holding said wire terminal in position; and a plurality of wire alignment slots aligned with said wire coupling slots respectively when said wire terminal is disposed at said guider holder, wherein each of said wire alignment slots is arranged for retaining said wire in position when said wire is inserted into said corresponding wire coupling slot, wherein said wire terminal is detached from said guider holder for disengaging said wires from said wire alignment slots respectively so as to ensure said wires to be retained at said wire coupling slots respectively, wherein said wire alignment unit comprises a base member defining said guider holder at a front portion and said wire alignment slots at a rear portion, such that when said wire terminal is disposed at said guider holder, said wire coupling slots are aligned with said wire alignment slots respectively.

19. The HDMI DIY connector kit, as recited in claim 18, wherein said wire alignment unit further comprises a hood cover foldably coupled with said base member and arranged in such a manner that said hood cover is folded to hood cover said wire terminal at said guiding holder to ensure said wire alignment slots to be aligned with said wire coupling slots respectively.

20. The HDMI DIY connector kit, as recited in claim 19, wherein an entrance of each of said wire alignment slots has a chamfered edge and a diameter of said wire alignment slot is gradually reduced from said entrance.

21. The HDMI DIY connector kit, as recited in claim 20, wherein an entrance of each of said wire coupling slots has a chamfered edge and a diameter of said wire coupling slot is gradually reduced from said entrance until said diameter of said wire coupling slot matches with a diameter of said wire.

22. A HDMI (High-Definition Multimedia Interface) DIY (Do-It-Yourself) connector kit for connecting wires of a HDMI cable, comprising:

a connector head which comprises a plurality of terminals;

a wire terminal having a plurality of wire coupling slots for enabling said wires to be inserted thereinto respectively, wherein said wire terminal is coupled with said connector head for conductively connecting wire conductors of said wires with said terminals respectively; and a wire alignment unit, which comprises:

a guider holder detachably holding said wire terminal in position; and a plurality of wire alignment slots aligned with said wire coupling slots respectively when said wire terminal is disposed at said guider holder, wherein each of said wire alignment slots is arranged for retaining said wire in position when said wire is inserted into said corresponding wire coupling slot, wherein said wire terminal is detached from said guider holder for disengaging said wires from said wire alignment slots respectively so as to ensure said wires to be retained at said wire coupling slots respectively, wherein an entrance of each of said wire alignment slots has a chamfered edge and a diameter of said wire alignment slot is gradually reduced from said entrance.

* * * * *